US007900469B2

(12) United States Patent
Gildersleeve

(10) Patent No.: US 7,900,469 B2
(45) Date of Patent: Mar. 8, 2011

(54) EVAPORATIVE COOLER HAVING A NOVEL AIR FLOW PATTERN

(75) Inventor: Paul Gildersleeve, Scottsdale, AZ (US)

(73) Assignee: Champion Cooler Corporation, Little Rock, AR (US)

( * ) Notice: Subject to any disclaimer, the term of this patent is extended or adjusted under 35 U.S.C. 154(b) by 483 days.

(21) Appl. No.: 12/037,348

(22) Filed: Feb. 26, 2008

(65) Prior Publication Data

US 2009/0211290 A1 Aug. 27, 2009

(51) Int. Cl.
*F28D 5/00* (2006.01)

(52) U.S. Cl. ..... 62/310; 62/314; 62/412

(58) Field of Classification Search ..... 62/304, 62/310, 314, 412, 259.4, 262; 261/151, 152; 454/62, 64

See application file for complete search history.

(56) References Cited

U.S. PATENT DOCUMENTS

| | | | | |
|---|---|---|---|---|
| 4,505,327 | A * | 3/1985 | Angle et al. | 165/48.1 |
| 4,827,733 | A * | 5/1989 | Dinh | 62/305 |
| 5,415,011 | A * | 5/1995 | Gilmore et al. | 62/262 |
| 5,927,097 | A * | 7/1999 | Wright | 62/309 |
| D419,230 | S | 1/2000 | Ciccone | |
| 6,101,831 | A | 8/2000 | Ciccone | |
| 6,253,559 | B1 * | 7/2001 | Kinkel et al. | 62/91 |
| 6,887,149 | B2 | 5/2005 | Palmer et al. | |
| 7,014,174 | B2 | 3/2006 | Roberts et al. | |
| 7,021,078 | B2 | 4/2006 | Kucera | |
| 7,100,906 | B2 | 9/2006 | Kucera | |
| 7,114,346 | B2 | 10/2006 | Kucera et al. | |
| 7,165,410 | B2 | 1/2007 | Carr et al. | |
| 7,174,741 | B2 * | 2/2007 | Lee et al. | 62/412 |
| 7,220,355 | B2 | 5/2007 | Palmer et al. | |
| 7,237,401 | B2 | 7/2007 | Kucera et al. | |
| 2005/0186899 | A1 | 8/2005 | Palmer et al. | |
| 2005/0268636 | A1 | 12/2005 | Palmer et al. | |
| 2006/0032258 | A1 * | 2/2006 | Pruitt et al. | 62/310 |

* cited by examiner

*Primary Examiner* — Mohammad M Ali
(74) *Attorney, Agent, or Firm* — RatnerPrestia

(57) ABSTRACT

An evaporative cooler and method of operating the evaporative cooler are described. The evaporative cooler comprises a reservoir configured to contain water, a frame, and panels. The panels together at least partially form a cooler housing and define an interior region of the cooler housing. The cooler housing has at least one inlet for the intake of ambient air and at least one outlet for the flow of cooled air out from the interior of the cooler housing. Media is positioned adjacent the at least one inlet such that the intake of ambient air passes through the media for heat exchange. A blower is positioned to receive air entering through the at least one inlet defined by the cooler housing and to exhaust cooled air toward the at least one outlet opening defined by the cooler housing.

6 Claims, 12 Drawing Sheets

EVAPORATIVE COOLER HAVING A NOVEL AIR FLOW PATTERN

FIELD OF THE INVENTION

This invention relates to an evaporative cooler and methods for operating an evaporative cooler.

BACKGROUND OF THE INVENTION

Evaporative coolers are commonly used in warm arid climates to cool air in a home, office or other environment. Conventional evaporative coolers operate by drawing hot or ambient, relatively dry air through water-soaked media. The ambient, dry air releases heat to evaporate water entrained in the water-soaked media thereby producing a stream of cooler, humid air. The cooled air is then directed into an area to be cooled.

Conventional evaporative coolers typically include an air blower, a media pad, and a water distribution system. The air blower induces the flow of air into the cooler. The ambient air is distributed through the media pad positioned in the air flow path. The air blower distributes the cooler air from the cooler. The water distribution system includes a water pump that draws water from a reservoir and distributes the water to a surface of the media pad. A proportion of the water contained within the media pad is evaporated as air is drawn through the media. The remaining water that is not absorbed by the media pad or evaporated returns to the reservoir. In this manner the water is recirculated. Fresh water is continuously added to replace the water that has been evaporated.

Improvements are continually sought to refine the operation, structural integrity, and/or functionality of evaporative coolers, as described herein.

SUMMARY OF THE INVENTION

According to one aspect of the invention, an evaporative cooler comprises a cooler housing having front, rear and side surfaces together defining an interior region. The front surface of the cooler housing defines an outlet opening positioned for the forward exhaust of cooled air from the interior of the cooler housing. The rear surface of the cooler housing defines an inlet opening positioned for the forward intake of ambient air into the interior of the cooler housing. Media is positioned within the interior of the cooler housing and adjacent the inlet opening defined by the rear surface such that the forward intake of ambient air passes through the media for heat exchange. A blower is mounted within the interior of the cooler housing and is positioned at an elevation above the inlet opening defined in the rear surface of the cooler housing. The blower has an inlet and an outlet and is configured to move air from the inlet to the outlet. The inlet of the blower is oriented to receive ambient air entering the interior of the cooler housing through the inlet opening defined in the rear surface. The outlet of the blower is oriented for the forward exhaust of cooled air from the outlet of the blower and toward the outlet opening defined in the front surface of the cooler housing.

According to another aspect of the invention, the front surface of the cooler housing also includes an inlet opening spaced from the outlet opening. The additional inlet opening is positioned for the rearward intake of ambient air into the interior of the cooler housing. Media is positioned within the interior of the cooler housing and adjacent the additional inlet opening defined by the front surface.

According to yet another aspect of the invention, the cooler housing is configured to be moved along a surface and the outlet of the blower is oriented to exhaust the cooled air at an upward angle with respect to the surface.

According to still another aspect of the invention, a method of cooling ambient air is provided. The method comprises the step of introducing or drawing ambient air into an interior region of a cooler housing through an inlet opening positioned on or defined in a front surface of the cooler housing for the rearward intake of ambient air. The method further comprises the step of expelling cooled air from the interior region of the cooler housing through an outlet opening positioned on or defined in the front surface of the cooler housing for the forward exhaust of cooled air.

BRIEF DESCRIPTION OF THE DRAWINGS

The invention is best understood from the following detailed description when read in connection with the accompanying drawings. It is emphasized that, according to common practice, the various features of the drawing are not necessarily to scale. On the contrary, the dimensions of the various features may be arbitrarily expanded or reduced for clarity. Included in the drawing are the following figures.

DETAILED DESCRIPTION OF THE INVENTION

Figure 1:
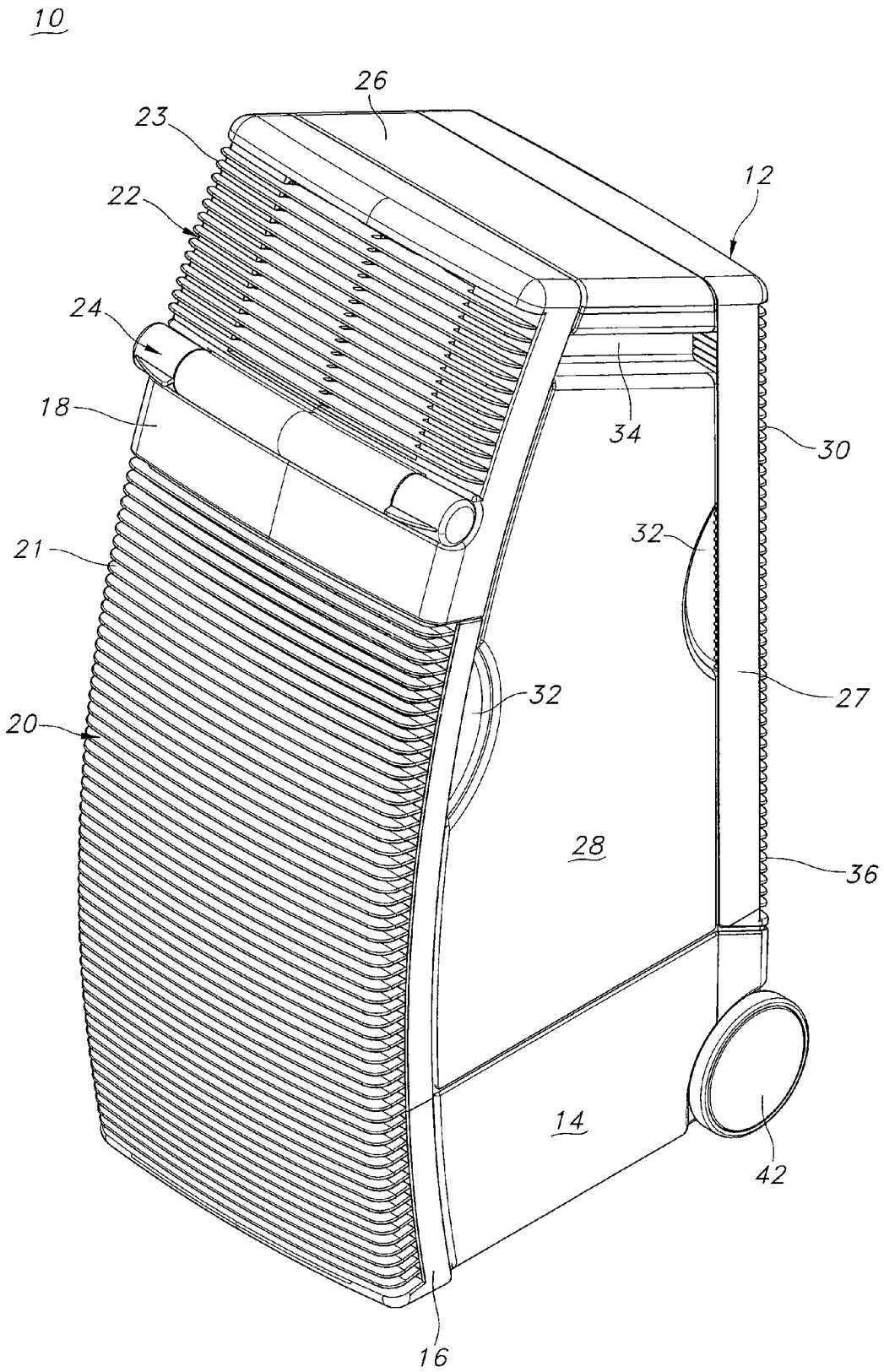
FIG. 1 depicts a perspective view of an exemplary embodiment of an evaporative cooler according to aspects of this invention.
Figure 2:
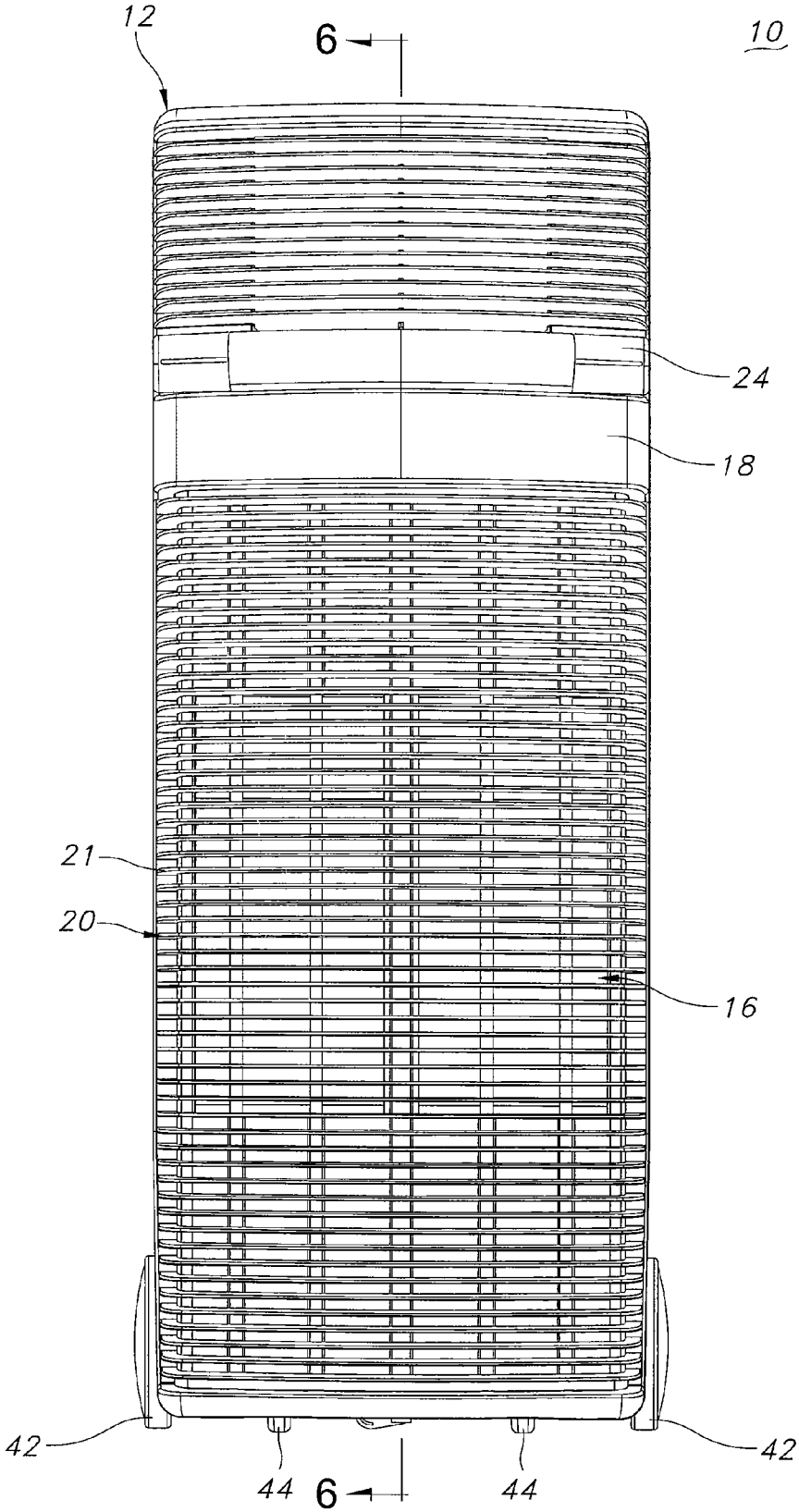
FIG. 2 depicts a front elevation view of the evaporative cooler of FIG. 1.
Figure 3:
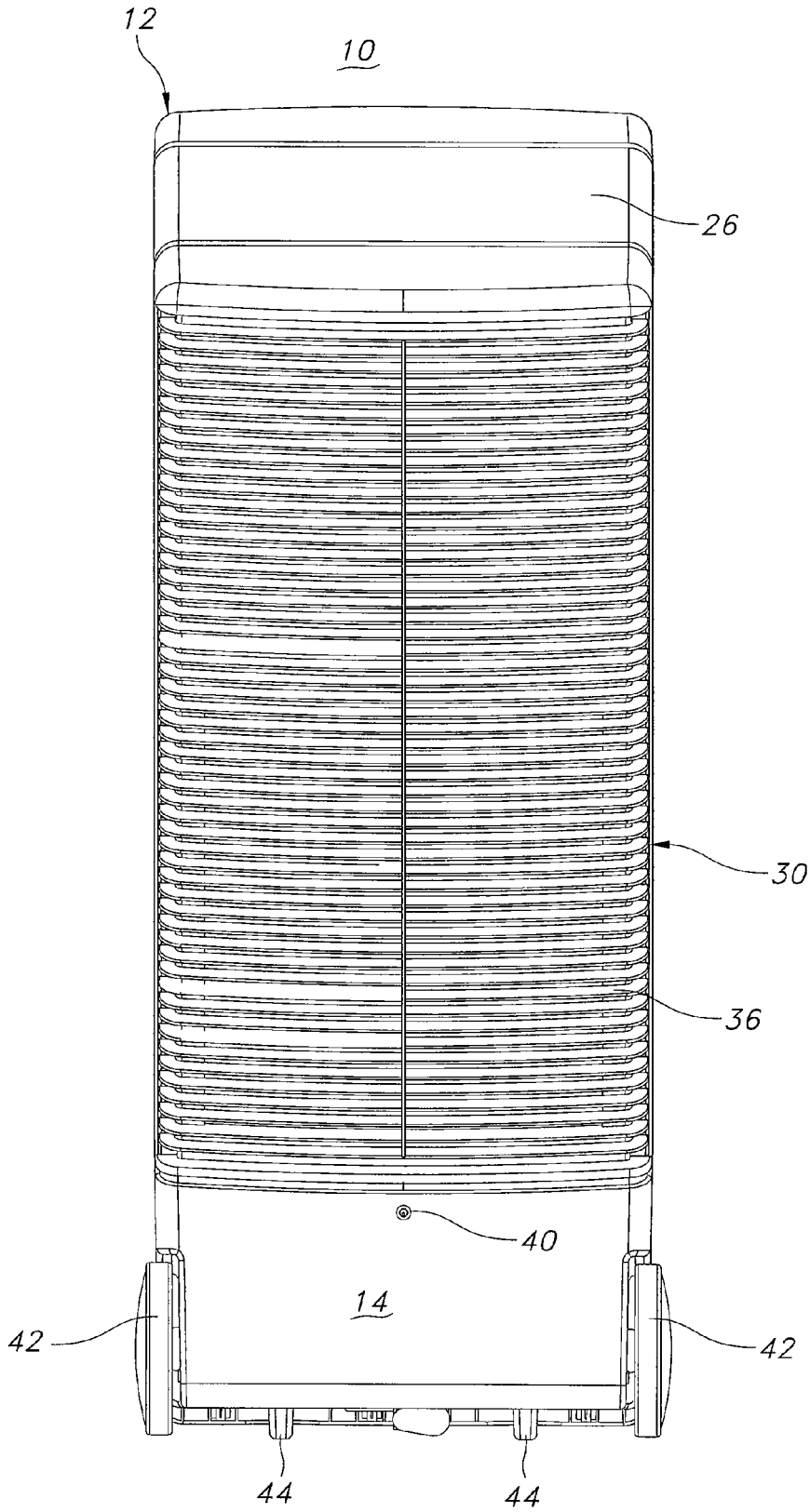
FIG. 3 depicts a rear elevation view of the evaporative cooler of FIG. 1.

Although the invention is illustrated and described herein with reference to specific embodiments, the invention is not intended to be limited to the details shown. Rather, various modifications may be made in the details within the scope and range of equivalents of the claims and without departing from the invention.

Referring generally to the figures, and according to one aspect of the invention, an embodiment of an evaporative cooler 10 comprises a cooler housing 12 having front, rear and side surfaces together defining an interior region. The front surface of the cooler housing 12 defines an outlet opening 56 positioned for the forward exhaust of cooled air from the interior of the cooler housing 12. The rear surface of the cooler housing defines an inlet opening 60 positioned for the forward intake of ambient air into the interior of the cooler housing 12. Media 53 is positioned within the interior of the cooler housing and adjacent the inlet opening 60 defined by the rear surface such that the forward intake of ambient air passes through the media 53 for heat exchange. A blower 50 is mounted within the interior of the cooler housing 12 and is positioned at an elevation above the inlet opening 60 defined in the rear surface of the cooler housing 12. The blower 50 has an inlet 84 and an outlet 86 and is configured to move air from the inlet 84 to the outlet 86. The inlet 84 of the blower 50 is oriented to receive ambient air entering the interior of the cooler housing 12 through the inlet opening 60 defined in the rear surface. The outlet 86 of the blower is oriented for the forward exhaust of cooled air from the outlet 86 of the blower and toward the outlet opening 56 defined in the front surface of the cooler housing 12.

According to another aspect of the invention, the front surface of the cooler housing also includes an inlet opening 58 spaced from the outlet opening 56. The additional inlet opening 58 is positioned for the rearward intake of ambient air into the interior of the cooler housing 12. Media 51 is positioned within the interior of the cooler housing 12 and adjacent the additional inlet opening 58 defined by the front surface.

According to yet another aspect of the invention, the cooler housing 12 is configured to be moved along a surface and the outlet 58 of the blower is oriented to exhaust the cooled air at an upward angle with respect to the surface.

According to still another aspect of the invention, a method of cooling ambient air is provided. The method comprises the step of introducing ambient air into an interior region of a cooler housing 12 through an inlet opening 58 positioned on a front surface of the cooler housing 12 for the rearward intake of ambient air. The method further comprises the step of expelling cooled air from the interior region of the cooler housing 12 through an outlet opening 56 positioned on the front surface of the cooler housing 12 for the forward exhaust of cooled air.

FIGS. 1-5 depict perspective, front, rear, side and exploded views, respectively, of an exemplary embodiment of an evaporative cooler 10. According to this exemplary embodiment, the evaporative cooler 10 generally includes a cooler housing 12 having front, top, rear and side panels together defining an interior region. A reservoir 14 configured to contain water is mounted at a bottom of the cooler housing 12 to one or more of the panels of the cooler housing 12. The reservoir 14 may also be considered to form part of the cooler housing 12. In use, the reservoir 14 rests near or on a floor surface.

The cooler housing 12 includes a front intake panel 16 and a front exhaust panel 18 positioned to at least partially form the front surface of the cooler housing 12. The front intake panel 16 and the front exhaust panel 18 may be two separate components, as shown, or, alternatively, may be provided as a single, unitary front panel. The front intake panel 16 defines an inlet opening 58 (see FIG. 5) positioned for the rearward intake of ambient air into the interior of the cooler housing 12, as depicted by the arrows in FIG. 4. An intake grille 20 is optionally positioned over the front intake panel 16.

The intake grille 20 optionally include a series of moveable or fixed louvers 21 defined along its height dimension. As an alternative to louvers and although not shown, the intake grille 20 may incorporate a fine mesh or wire material having small apertures sized for the passage of air.

The configuration of the intake grille 20 is selected to provide an ornamental appearance. For example, the convex and compound curvature of the intake grille 20, the shape of the louvers or mesh provided on the intake grille 20 or the openings they provide, and the overall shape and size of the intake grille 20 illustrated in the FIGS. are selected for ornamentation and are optionally varied without compromising the performance of the evaporative cooler 10.

Figure 4:
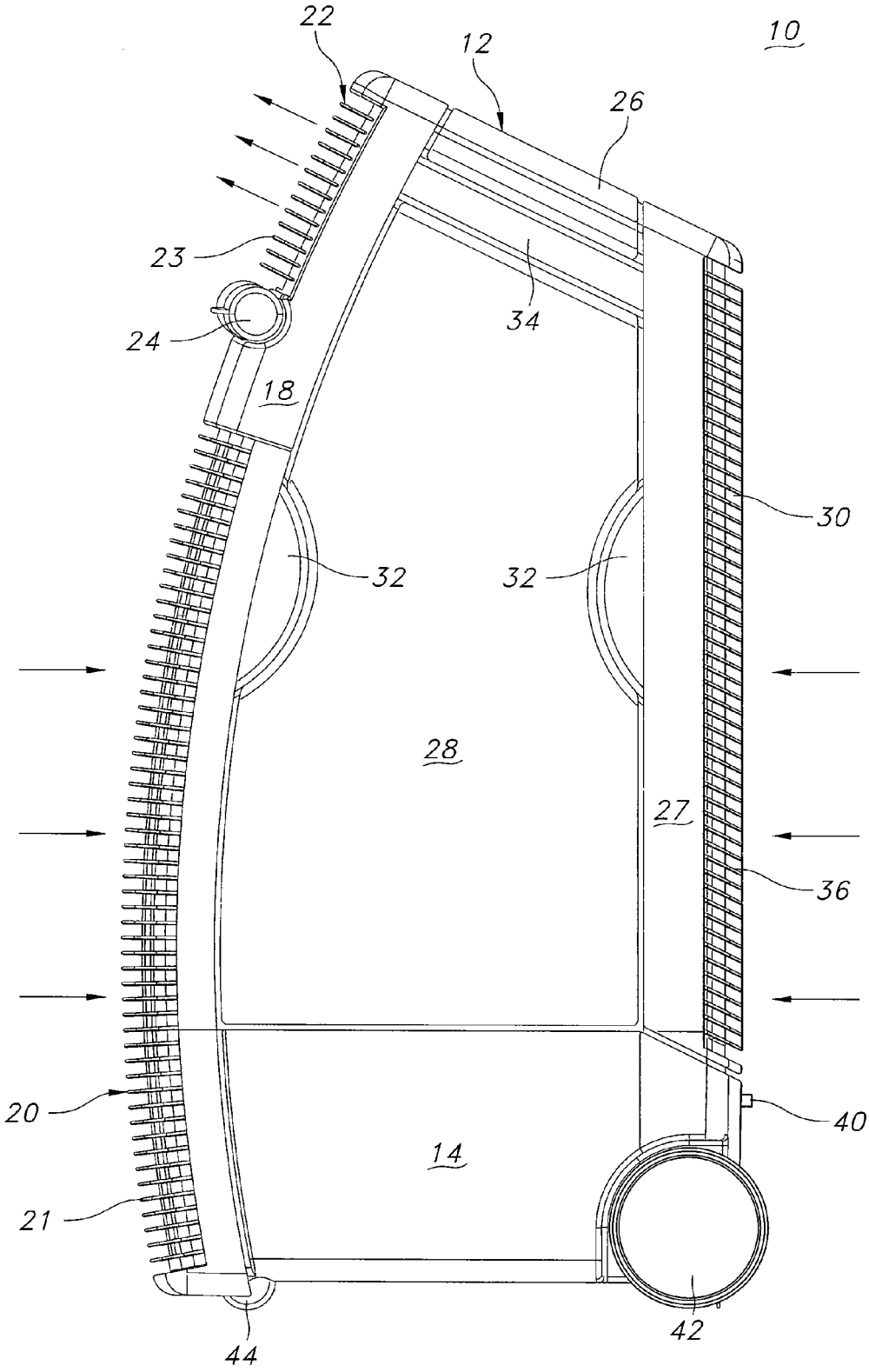
FIG. 4 depicts a right side elevation view of the evaporative cooler of FIG. 1.

The front exhaust panel 18 is positioned at an elevation above the front intake panel 16, and defines an outlet opening 56 (see FIG. 5) positioned for the forward exhaust of cooled air from the interior of the cooler housing 12, as depicted by the arrows in FIG. 4. An exhaust grille 22 is optionally positioned over the front exhaust panel 18. The exhaust grille 22 optionally includes a series of horizontally oriented louvers 23 defined along its height dimension. The louvers 23 are optionally adjustable in the upward and downward directions. Although not shown, a perforated mesh material or a wire material having small apertures sized for the passage of air may be positioned over the exhaust grille 22.

Like that of intake grille 20, the configuration of the intake grille 22 is selected to provide an ornamental appearance. For example, the optional convex and/or compound curvature of the intake grille 22, the shape of the louvers or mesh provided on the intake grille 22 or the openings they provide, and the overall shape and size of the intake grille 22 illustrated in the FIGS. are selected for ornamentation and are optionally varied without compromising the performance of the evaporative cooler 10.

Figure 5:
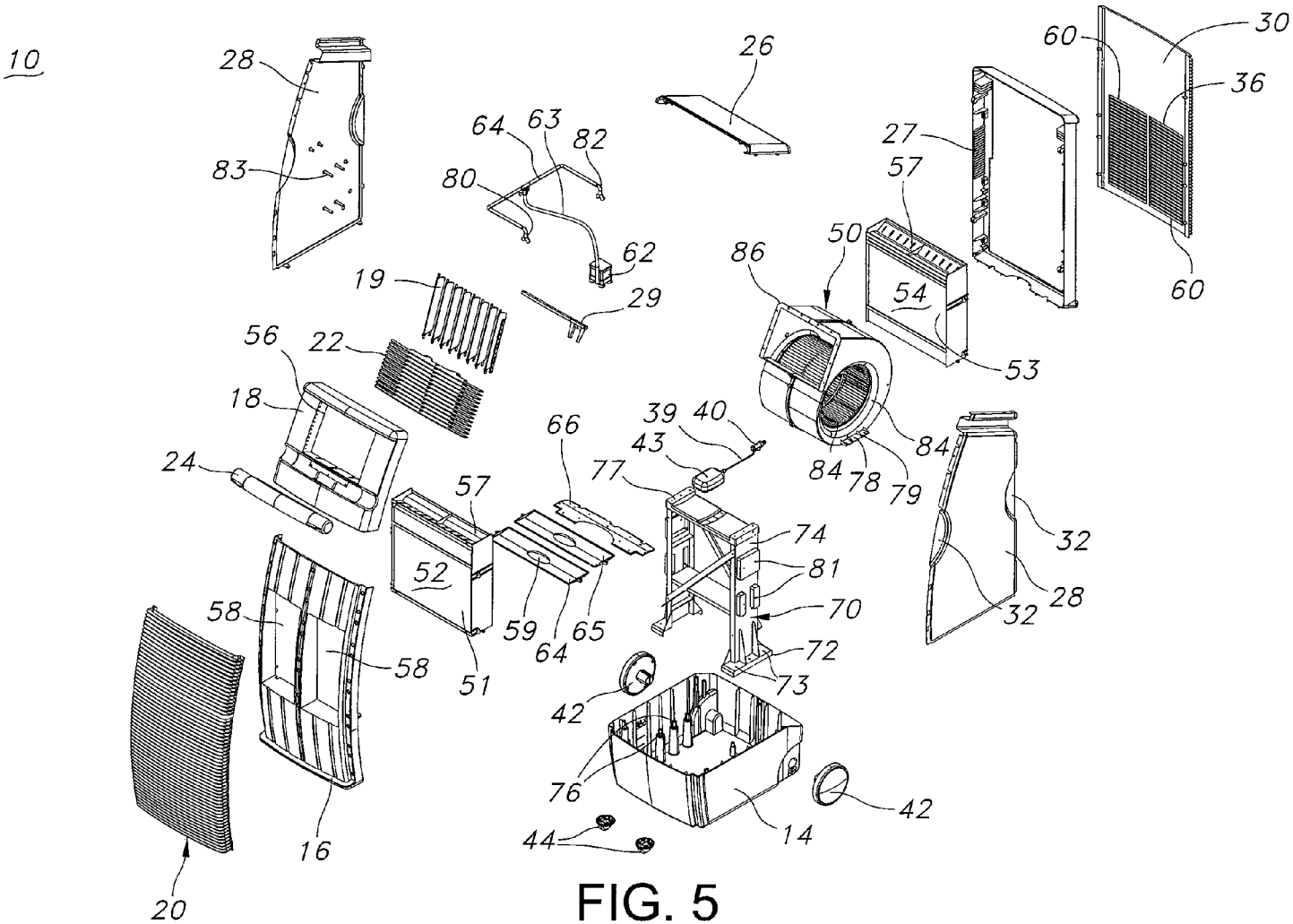
FIG. 5 depicts an exploded perspective view of the evaporative cooler of FIG. 1.

As best illustrated in FIG. 5, a series of vertically oriented, tiltable louvers 19 are mounted to the interior side of the fixed louvers 23. A louver oscillation bracket 29 interfaces with one or more of the tiltable louvers 19 for adjustably tilting the louvers 19 in a side-to-side direction. Tilting the louvers 19 adjusts the flow path of the exhaust air. The louvers 19 are optional components of the cooler 10 and may be eliminated.

The cooler housing 12 includes a rear intake panel 30 positioned along the rear surface of the cooler housing 12. The rear intake panel 30 defines an inlet opening 60 positioned for the forward intake of ambient air into the interior of the cooler housing 12, as depicted by the arrows in FIG. 4. A series of fixed louvers 36 are positioned on the rear intake panel 30, at least partially obscuring the inlet opening 60.

As best shown in FIG. 4, the louvers 36 are ornamentally angled with respect to a horizontal plane for aesthetic alignment with the angled top surface of the cooler housing 12. As an alternative to louvers and although not shown, the rear intake panel 30 may incorporate an ornamental mesh or wire material having small apertures sized for the passage of air. The configuration of the optional louvers 36 illustrated in the FIGS. is selected to provide an ornamental appearance. For example, the grille formed by the louvers 36, the shape of the louvers or mesh provided on the rear surface of the cooler housing 12, and the overall shape and size of the intake grille formed by louvers 36 illustrated in the FIGS. are selected for ornamentation and are optionally varied without compromising the performance of the evaporative cooler 10.

Two side panels 28 of the cooler housing 12 are positioned along the sides of the cooler 10 to define side surfaces of the cooler housing 12. The side panels 28 are substantially closed to air flow to force the flow of air through the inlet openings 58 and 60 that are provided in the front and rear surfaces of the cooler housing 12. Each side panel 28 optionally includes two ornamental crescent-shaped handles 32 formed on opposing sides thereof, and an ornamental rectangular handle 34 for gripping the top of the cooler 10 and tilting the cooler 12 rearwardly. The handles 32 and 34 are optionally in the form of ornamental depressions formed in the material of each side panel 28. The cooler 10 may also include a handle (not shown) mounted to the top surface thereof.

The top panel 26 is positioned along the top of the cooler 10 to define a top surface of the cooler housing 12. The top panel 26 may be transversely oriented with respect to a horizontal plane, as shown, for purposes of ornamentation. An intermediate panel 27 is positioned along the rear surface of the cooler housing 12 and coupled to both side panels 28, the rear panel 30, the top panel 26, and the reservoir 14. The rear intake panel 30 is fastened to the intermediate panel 27 by releasable mechanical fasteners (not shown) or by other fastening mechanisms. The intermediate panel 27 may optionally be integrated with the rear intake panel 30 or they may be two separate components, as shown.

An ornamental control mechanism or panel 24 configured for controlling the operation of the evaporative cooler 10 is optionally positioned along the front surface of the cooler housing 12. The control panel 24 may be integrated with or mounted to the front exhaust panel 18, as shown, or it may be integrated with or mounted to the front intake panel 16, or, as another alternative, it may be an entirely separate component altogether. By way of non-limiting example, the control panel 24 may include one or more of the following provisions for controlling and/or observing the operation of the evaporative cooler 10: exhaust air temperature selection knob, exhaust air velocity selection knob, a timer, a thermostat, a digital display, and/or an analog display. The control panel 24 may incorporate knobs, levers, buttons, or any other mechanisms for adjustably controlling the operation of the cooler 10. Those skilled in the art will recognize that the control panel 24 may include a number of other provisions for either controlling or observing the operation of the evaporative cooler 10 without departing from the spirit or scope of the invention. It should also be recognized that the ornamental configuration of the control panel 24 illustrated in the FIGS. is selected for aesthetic reasons and that the configuration of the control panel 24 can be changed without compromising the control of the cooler 10.

The reservoir 14 includes a hollow interior portion for storing water. The hollow interior of the reservoir 14 may be sized to hold 1 to 15 gallons of water, for example, or any other volume of water. In use, the reservoir 14 is positioned on or adjacent a floor surface. A fitting 40 is coupled to a rear wall of the reservoir 14 to permit the cooler to be filled from a conventional water source, such as a garden hose, for example. The fitting 40 is an optional component of the cooler 10, and may be omitted.

Although not shown, the reservoir 14 may be removably mounted to the cooler housing 12. In this manner, the reservoir 14 may be at least partially removed, refilled with water, and reinstalled into the cooler housing 12. Alternatively, an aperture, a removable door, or a moveable door may be provided in one or more of the panels of the cooler housing 12 to permit manual delivery of water into the reservoir 14.

The cooler 10 optionally includes a pair of wheels or casters 42 for rolling the cooler along a surface. The casters 42 are optionally mounted to the side or underside of the reservoir 14 and positioned proximal to the rear surface of the cooler housing 12. The cooler 10 optionally includes another pair of wheels or casters 44 mounted to the side or underside of the reservoir 14 and positioned proximal to the front surface of the cooler housing 12. The casters 42 positioned near the rear surface of the cooler 10 may be larger than the casters 44 positioned near the front surface of the cooler 10, as shown in FIG. 4. It should be understood that the casters 42 and 44 are optional components of the cooler 10. The casters 42 and 44 may be particularly useful for transporting the cooler if the end-user is unable to lift the cooler 10.

According to one exemplary method of assembling the cooler housing 12, the lower portion of the front intake panel 16 is releasably mounted to the reservoir 14. The front exhaust panel 18 is releasably mounted to the top portion of the front intake panel 16. The top panel 26 is releasably mounted to the top portion of the front exhaust panel 18. Both side panels 28 are releasably mounted to the top panel 26, the front intake panel 16, the front exhaust panel 18 and the reservoir 14. The intermediate panel 27 is mounted to the top panel 26, the reservoir 14 and the side panels 26. The rear intake panel 30 is releasably mounted to the intermediate panel 27 and the reservoir 14. Any of the foregoing components may be releasably mounted by fasteners, or any other means for fastening known in the art. By way of non-limiting example, means for fastening may include fasteners (e.g., screws, bolts, staples), adhesive, clips, clamps, welds, pins, posts, and so forth. Alignment tabs and/or slots for receiving the alignment tabs may be positioned on any of the foregoing components to facilitate assembly of the cooler housing 12.

Ornamental features of the entire cooler housing 12 are illustrated in co-pending U.S. Design patent application Nos. 29/304,140, 29/304,141, 29/304,148, 29/304,150, 29/304,156, 29/304,157, and 29/304,158, which are incorporated herein by reference in their entirety. The individual components of the cooler housing 12 can have a wide variety of colors, color combinations, materials, ornamental shapes and configurations, including a variety of proportions, cross-sections, thicknesses, and curvatures. By way of non-limiting example, ornamentation is provided by the arc-shaped profile of the grilles 20 and 22, the arc-shaped and cylindrical profile of the control panel 24, the recessed crescent and rectangular handles 32 and 34, and the optional metallic look and finish of portions of or the entire cooler 10.

Figure 6:
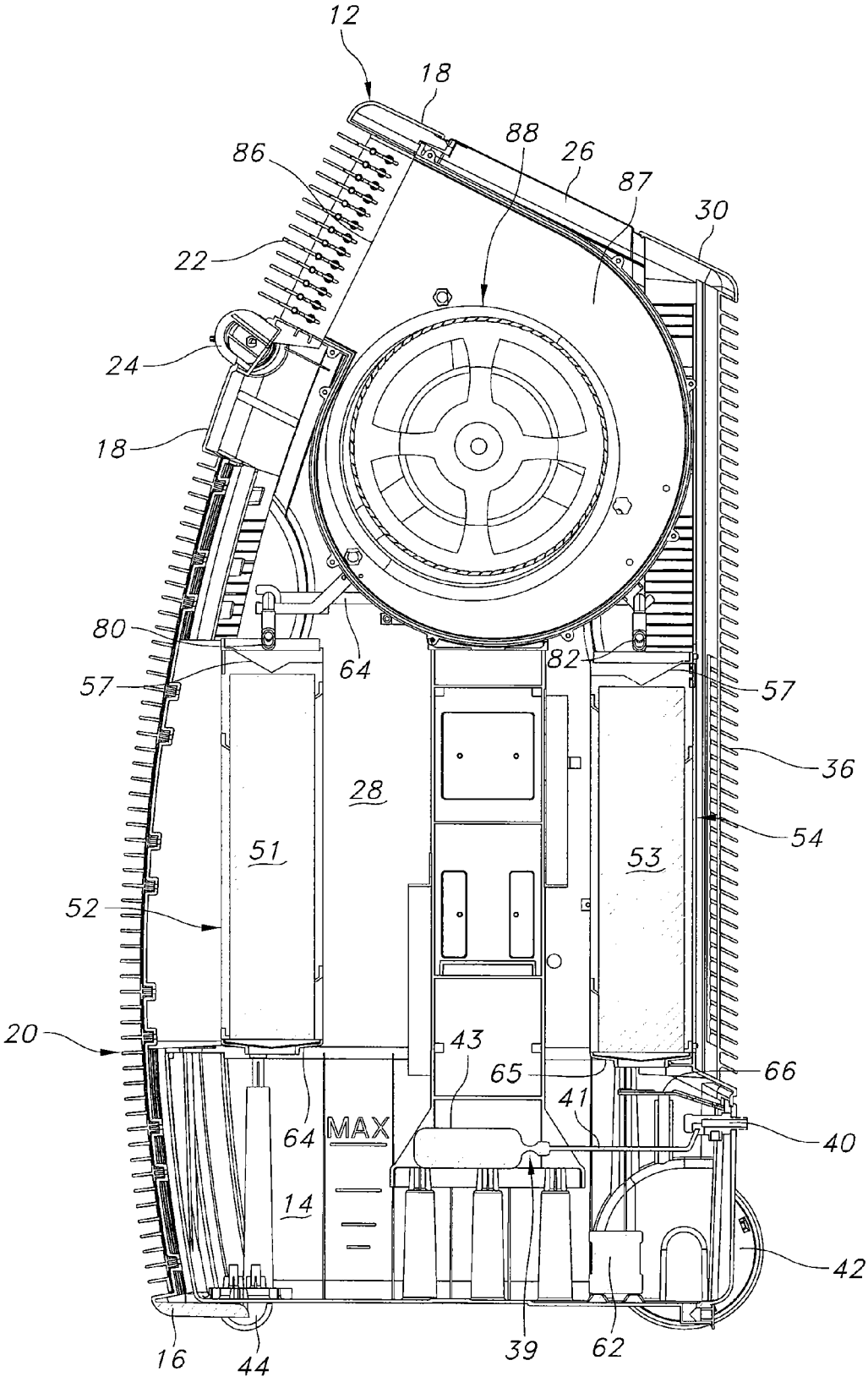
FIG. 6 depicts a cross-sectional side view of the evaporative cooler of FIG. 2 taken along the lines 6-6.

Referring now to the internal components of the evaporative cooler 10 illustrated in FIGS. 5 and 6, components for accomplishing the evaporative cooling process are positioned within the interior of the cooler housing 12. FIG. 6 depicts a cross-sectional view of the cooler 10 of FIG. 2 taken along the lines 6-6.

The evaporative cooler 10 includes an air blower 50 for inducing the flow of ambient air through the inlet ports 58 and 60, drawing air through the media pads 51 and 53 for heat exchange, and exhausting the cooled air through the outlet port 56 defined in the front exhaust panel 18. As described previously, evaporative coolers operate by drawing hot or ambient, relatively dry air through water-soaked media. The hot or ambient air releases heat to evaporate water entrained in the water-soaked media thereby producing a stream of cooler, humidified air. The cooled air is then directed into an area to be cooled.

The air blower 50 defines two inlet ports 84 defined on opposing sides thereof for receiving air, and one outlet port 86 for exhausting air. As best shown in FIG. 6, an air channel 87 is defined within the interior of the air blower 50 for providing a passageway for the flow of air between the inlet ports 84 and the outlet port 86. The air blower 50 further includes a motorized impeller 88, or other means, for drawing air through the air channel 87. Although not shown, a wire mesh (having ½"×½" square apertures, for example) may be positioned over the outlet opening of the blower housing for safety purposes. Further details of the air blower 50 are provided in U.S. Pat. No. 7,114,346 to Kucera et al., which is incorporated by reference herein in its entirety.

The outlet port 86 of the blower 50 is aligned with the outlet port 56 of the front exhaust panel 18. Each inlet port 84 of the air blower 50 is positioned near a side panel 28 of the cooler housing 12. A longitudinal axis "A" of the blower 50 is oriented substantially parallel to the front and rear panels 16 and 30, respectively, of the cooler housing 12, and the inlet ports 84 are positioned substantially perpendicular to longitudinal axis "A".

It has been discovered that the orientation of the blower, the media pad(s), the inlet opening(s) and/or the outlet opening(s) of the cooler can together confer significant benefits in terms of cooler performance and space savings. For example, it has been discovered that a cooler having a reduced "footprint" can be provided according to this invention and that such a reduced footprint can result in significant floor space savings. By positioning the blower at an elevation that is at least partially if not completely above the media pad(s), by substantially preventing or reducing the inlet of air at the sides of the cooler, by moving the side walls inwardly toward the inlet(s) of the blower, and/or by orienting the axis of the blower to be parallel to the front surface of the cooler, a cooler having a smaller footprint can be provided without compromising its cooling performance. Also, by orienting the blower such that its axis is parallel to the faces of the air inlet(s) of the cooler housing and/or by positioning the blower inlet(s) at an elevation above the inlet(s) of the cooler housing or the media pad(s), air can be drawn into the blower with reduced entrainment of water droplets from the media pad(s) in the cooler housing. Such reduced entrainment helps to eliminate or reduce "spitting" of water droplets with cooled air.

Adequate space exists between each inlet port 84 and the adjacent side panel 28 to permit the passage of air into each inlet port 84 of the air blower 50. Accordingly, air flows into cooler 10 through the rear surface of the cooler housing 12 and along the sides of the blower 50 generally along a first direction and then flows into the inlets 84 of the blower generally parallel to axis "A" and substantially perpendicular to the first direction. Similarly, air flows into cooler 10 through the front surface of the cooler housing 12 and along the sides of the blower 50 generally along a third direction substantially opposite to the first direction and then flows into the inlets 84 of the blower generally parallel to axis "A" and substantially perpendicular to the first and third directions.

A media pad housing 52, which includes a media pad 51 contained therewithin, is releasably mounted to the interior side (not shown) of the front intake panel 16 by fasteners or other fastening means. For reference purposes, the term 'interior side' refers to the side of a panel that faces the interior of the cooler housing 12. The media pad housing 52 is positioned adjacent the inlet opening 58 provided in the front intake panel 16 such that the intake of ambient air passes through the media pad 51 for heat exchange. The media pad 51 consumes nearly the entire width of the cooler housing 12.

A second media pad housing 54, which also includes a media pad 53 contained therewithin, is releasably mounted to the interior side of the intermediate panel 27 by fasteners or other fastening means. The media pad housing 54 is positioned adjacent the inlet opening 60 provided in the rear intake panel 30 such that the intake of ambient air passes through the media pad 53 for heat exchange.

As best shown in FIG. 6, each media pad housing 52 and 54 includes an inlet channel 57 for channeling water onto a top surface of a respective media pad 51 and 53. The media pads 51 and 53 may be provided in the form of a sponge, layered expanded paper, layered corrugated paper (rigid media blocks), polyester (woven and/or non-woven), or aspen wood shavings, for example.

Although media pad housing 54 is positioned below the blower 50 (thereby permitting a reduction of the depth of the cooler 10 from its front surface to its rear surface), media pad 54 can optionally extend upwardly behind the blower 50. In fact, it may be preferred according to exemplary embodiments of this invention to provide a media pad that extends to an elevation above the bottom of the blower in order to increase the size of the air inlet opening and/or to increase the surface area of the media through which ambient air is drawn.

The evaporative cooler 10 includes a water distribution system configured for continuously wetting the media pads 51 and 53 encapsulated within the media pad housings 52 and 54, respectively. More particularly, the water distribution system generally includes a submersible water pump 62, a manifold 64, and a hollow conduit fluidly coupled between the water pump 62 and the manifold 64. The water pump 62 is positioned on the floor of the reservoir 14, i.e., beneath the surface of the water within the reservoir 14. The water pump 62 is configured to deliver water from the reservoir 14 through an outlet port provided on the pump 62. The outlet port of the water pump 62 is coupled to one end of a hollow conduit 63 for delivering water into the conduit 63. Details of the water pump 62 are described in greater detail in U.S. Pat. No. 7,220,355 to Palmer et al., which is incorporated by reference herein in its entirety.

The opposing end of the conduit 63 is coupled to an inlet port provided on a manifold 64. The manifold 64 includes two hollow branch portions, each branch defining two nozzles 80 and 82 for distributing water onto a top surface of a media pad 51 and 53, respectively. The nozzles 80 and 82 are positioned over the inlet channel 57 of the media pad housings 52 and 54, respectively. Additionally, the nozzles 80 and 82 of the manifold 64 are positioned distal from the inlet ports 84 of the air blower 50 to limit or prevent expelled water from being drawn into the inlet ports 84 of the blower 50.

A drip pan 64 and 65 is mounted to the underside of each media housing 52 and 54, respectively, by a fastener or other fastening means. The drip pans 64 are provided for collecting excess water expelled from each media pad 51 and 53. Each drip pan 64 includes an aperture 59 positioned for redirecting the collected water into the reservoir 14.

An optional splash guard 66 is mounted to the reservoir 14 and positioned beneath the drip pan 65. The splash guard 66 is positioned to limit or prevent water from exiting the reservoir 14 through the rear surface of the cooler housing 12 upon tilting the evaporative cooler 10.

The cooler 10 optionally includes a float operated valve 39 comprising a valve fitting 40, a float 43, and a hollow rod 41 fluidly coupled between the valve fitting 40 and the float 43. More particularly, the fitting 40 is coupled to a rear wall of the reservoir 14 for receiving water via a conventional water source, such as a garden hose, for example. The valve fitting 40 optionally includes a threaded region for receiving the threaded end of a garden hose adapter, for example. The valve fitting 40 is connected to the float 43 by the hollow rod 41 that is composed of a metallic or a plastic material, for example.

In use, water is selectively introduced into the interior of the reservoir 14 by the float operated valve 39. More particularly, the float operated valve 39 is configured to selectively permit the automatic filling of the reservoir 14 by the conventional water source. Once the desired water level is reached within the reservoir 14, the float operated valve 39 is configured to interrupt the flow of water into the reservoir 14. As indicated by its name, the float 43 of the float operated valve 39 is configured to float on the surface of the water contained within the reservoir 14. Further details of the float operated valve 39 are described in greater detail in U.S. Pat. No. 7,220,355 to Palmer et al.

As best shown in FIG. 6 and according to one exemplary embodiment, the blower 50 is positioned at an elevation above the inlet openings 58 and 60 of the cooler housing 12.

The blower 50 is also positioned at an elevation above the media pads 51 and 53, given that the media pads 51 and 53 are respectively positioned directly adjacent the inlet openings 58 and 60. Positioning the blower 50 at an elevation above the media pads 51 and 53 provides for efficient utilization of the available interior space of the cooler housing 12. Because the cooler 10 is transportable, it is beneficial to minimize the overall size of the cooler 10 for the purpose of convenience and portability.

More particularly, the reservoir 14, the air blower 50 and the media pads 51 and 53 (and their respective housings 52 and 54) consume a large proportion of the interior space of the cooler housing 12. The reservoir 14 is ideally positioned on the bottom end of the cooler housing 12 for the purpose of weight distribution, i.e., to limit or prevent the cooler 10 from inadvertently tipping over on its side. The media is pads 51 and 53 are ideally positioned above and adjacent the reservoir 14 to channel excess water into the reservoir 14 while avoiding inadvertently wetting other components of the cooler 10. Thus, it follows that the air blower 50 is ideally positioned at an elevation above the media pads 51 and 53 to utilize the remaining interior space within the cooler housing 12 not consumed by the reservoir 14 and the media pads 51 and 53. Nevertheless, alternative arrangements of the components within the interior of the cooler housing are contemplated as well. Such alternative arrangements may be selected for particular applications or for coolers having different housing shapes, housing sizes, inlet or outlet configurations, and/or other variations.

Figure 7:
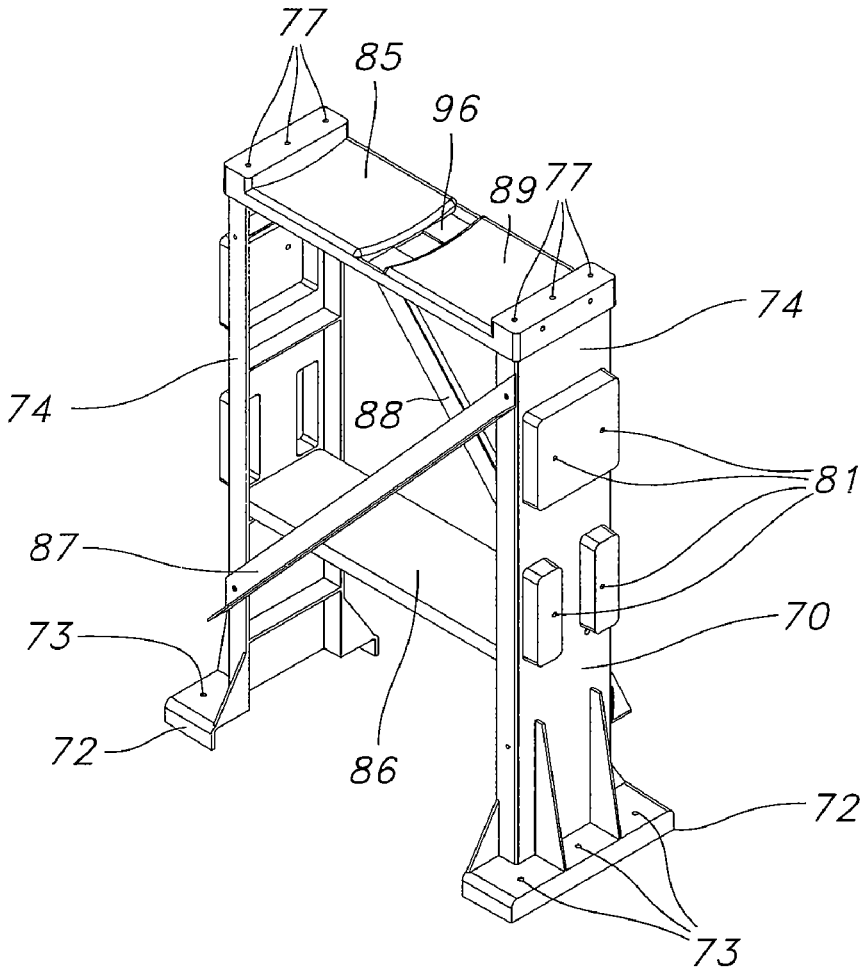
FIG. 7 depicts a perspective view of an embodiment of a frame component of the evaporative cooler of FIG. 1.

FIG. 7 depicts a perspective view of the frame member 70 of FIG. 5. The frame member 70 includes a base portion 72 coupled to the reservoir 14 and two elevated portions 74 extending upwardly from the base portion 72. The base portion 72 of the frame member 70 includes six thru-holes 73 (four shown) that are positionable into alignment with six threaded holes provided on mounting bosses 76 (three shown) of the reservoir 14. The mounting bosses 76 extend upwards from the bottom end of the reservoir 14. To mount the frame member 70 to the reservoir 14, a fastener (not shown) is positioned through each thru-hole 73 of the frame member 14 and threaded into a corresponding threaded hole of the mounting boss 76 of the reservoir 14. It should be understood that other ways of mounting the frame member 70 to the reservoir 14 exist.

The frame member 70 includes four holes 81 positioned on each side of the elevated portion 74 for receiving four fasteners 83 positioned through or extending from each side panel 28. It should be understood that other ways of releasably or permanently mounting the side panels 28 to the frame member 70 exist and are contemplated as well.

The air blower 50 is mounted to and supported by the elevated portion 74 of the frame member 70. The elevated portion 74 of the frame member 70 includes six threaded holes 77 that are positionable into alignment with six corresponding thru-holes 78 (three shown) extending from mounting flanges 79 (one shown) positioned on opposing sides of the air blower 50. To mount the air blower 50 to the frame member 70, a fastener (not shown) is positioned through each hole 78 of the air blower 50 and threaded into a corresponding threaded hole 77 of the frame member 70. It should be understood that other ways of permanently or releasably mounting the air blower 50 to the frame member 70 exist and are contemplated as well.

The frame member 70 is particularly useful for supporting the weight of the air blower 50 and individual panels of the cooler housing. The frame member 70 provides a direct structural path from the air blower 50 to the reservoir 14 that forms the base of the cooler housing 12. Alternatively, the air blower could be mounted directly to one or more of the housing panels. Because the panels are typically not designed to support the heavy weight of an air blower, however, the panels could potentially deflect, bend or break under the weight of the air blower. Therefore, it is beneficial according to exemplary embodiments of the invention to provide an internal frame such as frame member 70. Although not shown, the media pad housings 52 and 54 or the front and rear panels 16 and 30 may also be directly mounted to or supported by the frame member 70.

Additionally, by mounting the air blower 50 to the frame member 70, as opposed to a housing panel, a housing panel of the evaporative cooler 10 may be more easily removed and replaced with a different housing panel without removing or disassembling the air blower. This may be particularly advantageous if the housing panels are provided in kit form, such that a housing panel may be conveniently removed and replaced with another housing panel having a different color, material or pattern, without removing or disassembling the air blower. Such interchangeability of the panels facilitates panel replacement for repair of damaged panels or for updating colors and color combinations. Therefore, the "endoskeleton" structure provided by the internal frame member 70 of the illustrated embodiment of cooler 10 confers several advantages (e.g., the support of internal components such as the blower, the optional use of removable panels, etc.) as compared to an "exoskeleton" structure in which an external surface of the cooler is used to support internal components, although both configurations are contemplated.

The frame member 70 includes four cross members 85, 86, 87 and 88 extending between the opposing elevated portions 74. The top cross member 85 is positioned at the top of the frame member 70 for supporting the weight of the air blower 50. The mounting surface 89 of the top cross member 85 is rounded to accommodate the rounded underside portion of the air blower 50. The rounded top surface 89 of the top cross member 85 includes a recessed portion 96 to accommodate a flange of the air blower 50 (see FIG. 5). A central cross member 86 is mounted between the opposing elevated portions 74 to limit or prevent buckling of the elevated portions 74. Two cross members 87 and 88 extend from the top end of one elevated portion 74 to the bottom end of the opposing elevated portion 74 in a criss-cross fashion. The cross members 87 and 88 limit or prevent torsion of the frame member 70.

According to one aspect of the invention, the frame member 70 is an assembly composed of separate components including the opposing elevated portions 74; the four cross members 85, 86, 87 and 88; and the base portions 72. Alternatively, the frame member 70 may be of unitary construction. The frame member 70, or components thereof, may be formed from any metallic or plastic material sufficient to withstand the weight and stress applied by the blower 50.

Referring now to the operation of the evaporative cooler 10 and according to one exemplary method of operating the evaporative cooler, ambient air is introduced into an interior region of the cooler housing 12 through an inlet opening 58 positioned on a front surface of the cooler housing 12 for the rearward intake of ambient air. The ambient air is delivered through media 51 positioned within the interior of the cooler housing 12 and adjacent the inlet opening 58 defined by the front surface such that the rearward intake of ambient air passes through the media 51 for heat exchange.

Ambient air is also introduced into the interior region of the cooler housing through an inlet opening 60 positioned on a rear surface of the cooler housing 12. The ambient air is delivered through media 53 positioned within the interior of the cooler housing 12 and adjacent the inlet opening 60 defined by the rear surface such that the forward intake of ambient air passes through the media 53 for heat exchange. Providing separate inlet openings 58 and 60 on the front and rear surfaces of the cooler housing 12 is particularly beneficial to maximize heat transfer and to make efficient use of the available interior space within the cooler housing 12.

The steps of introducing air comprise operating a blower 50 that is configured to draw air into the interior region of the cooler housing through the inlet openings 58 and 60 positioned on the cooler housing 12. Cooled air is expelled from the interior region of the cooler housing 12 through the outlet opening 56 positioned on the front surface of the cooler housing 12 for the forward exhaust of cooled air. The step of expelling air comprises operating the blower 50, which is configured to exhaust air from the interior region of the cooler housing 12 through the outlet opening 56 positioned on the front surface of the cooler housing 12.

Figure 8:
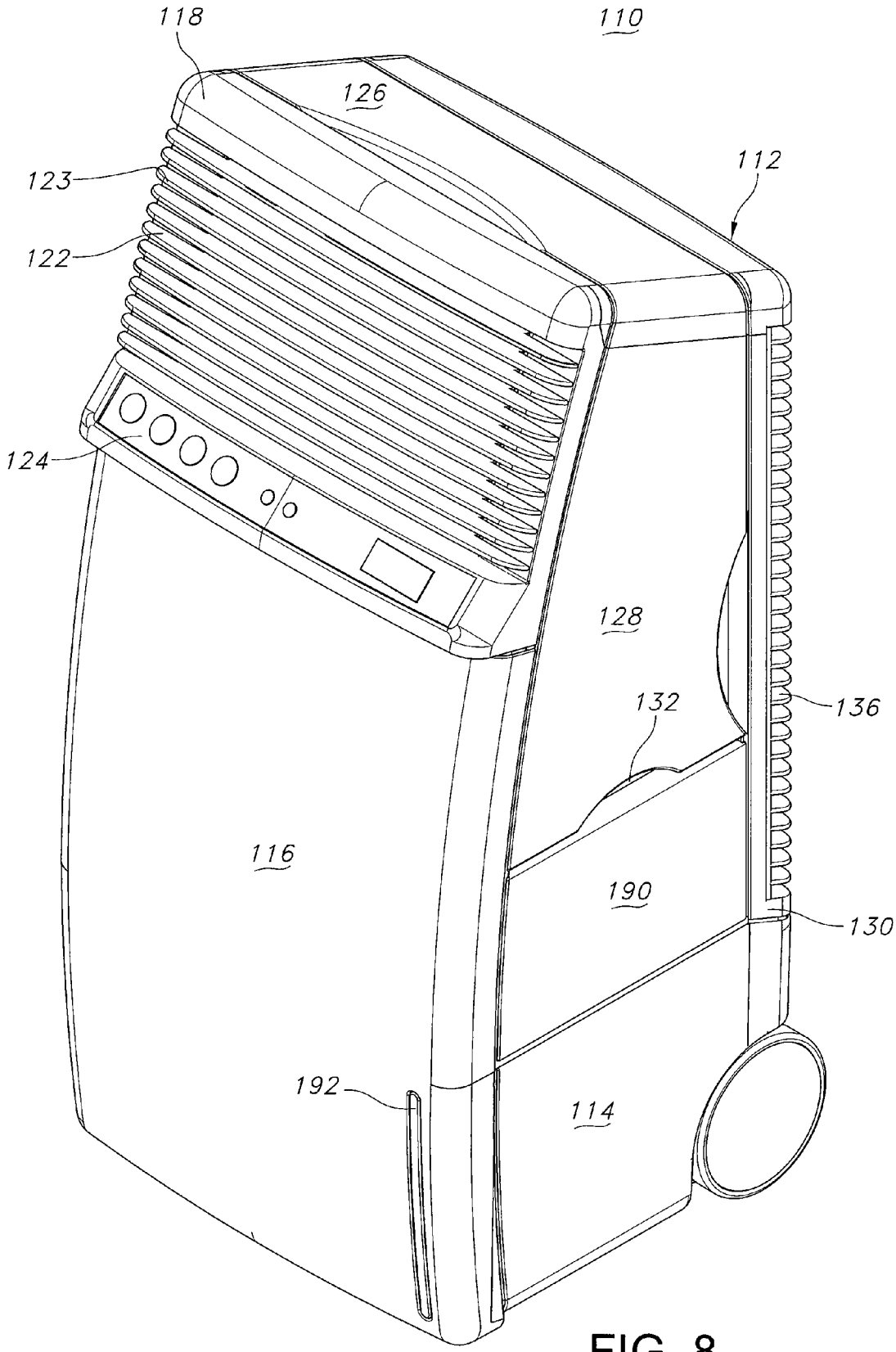
FIG. 8 depicts a perspective view of another exemplary embodiment of an evaporative cooler according to aspects of this invention.
Figure 9:
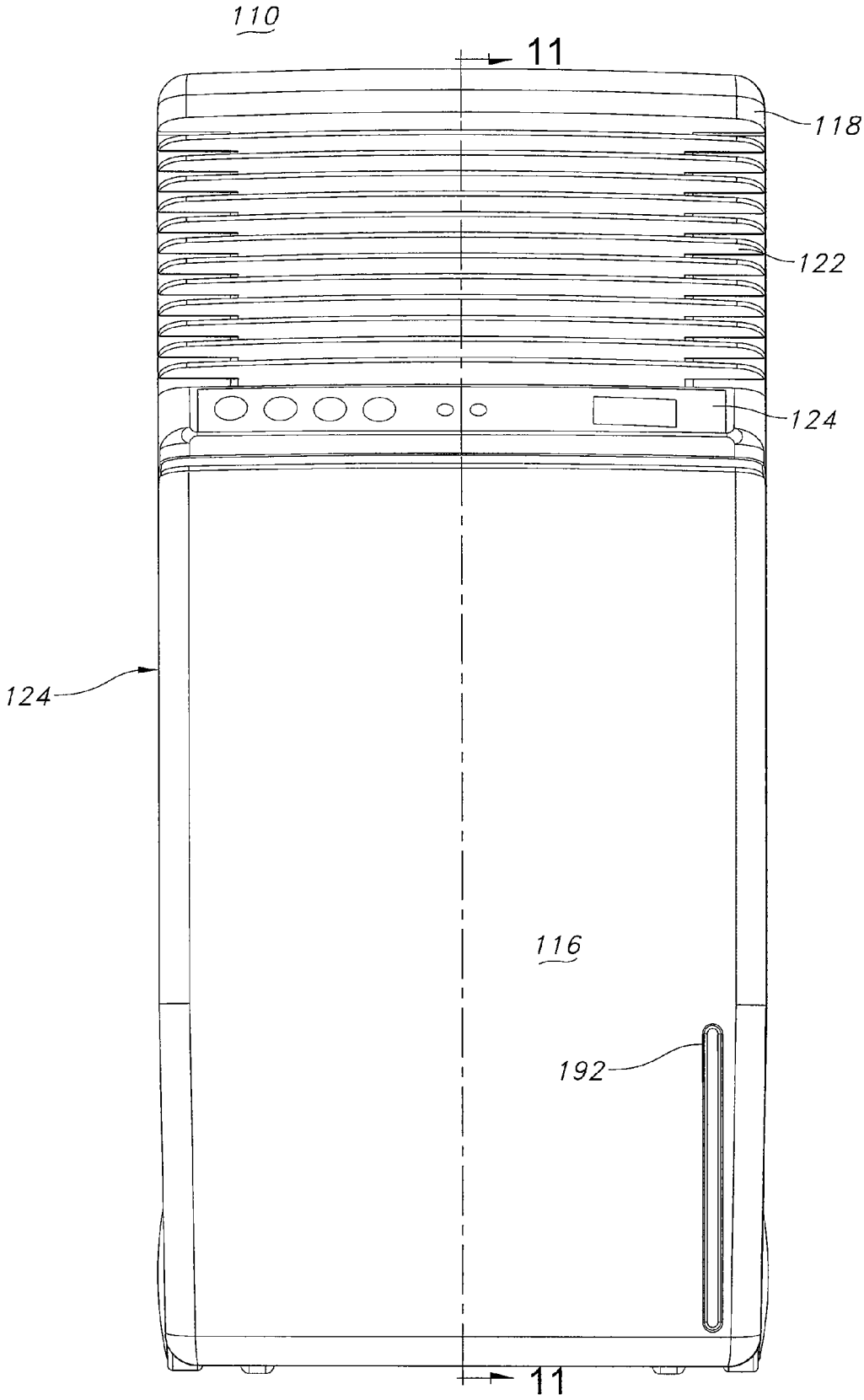
FIG. 9 depicts a front elevation view of the evaporative cooler of FIG. 8.
Figure 10:
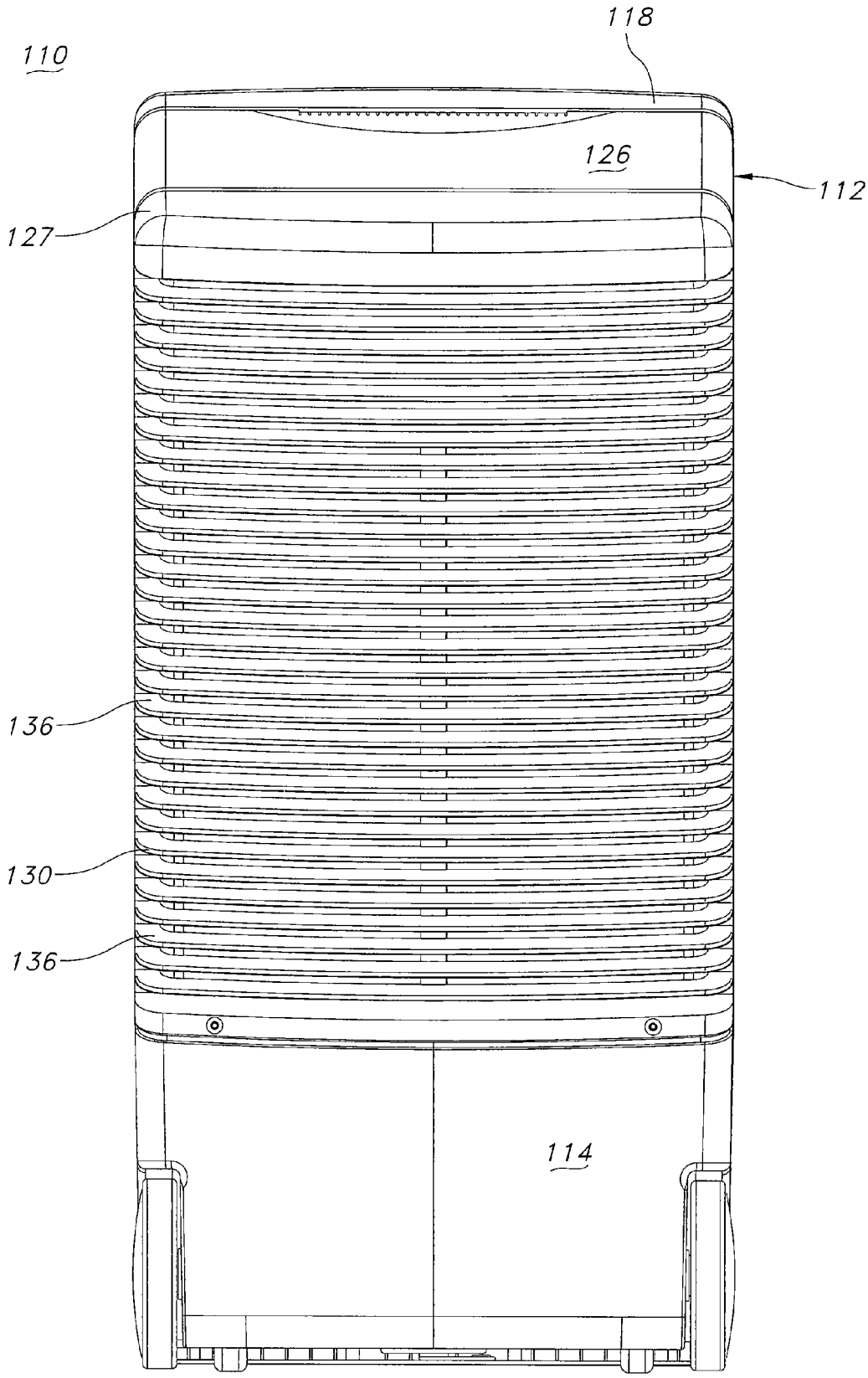
FIG. 10 depicts a rear elevation view of the evaporative cooler of FIG. 8.
Figure 11:
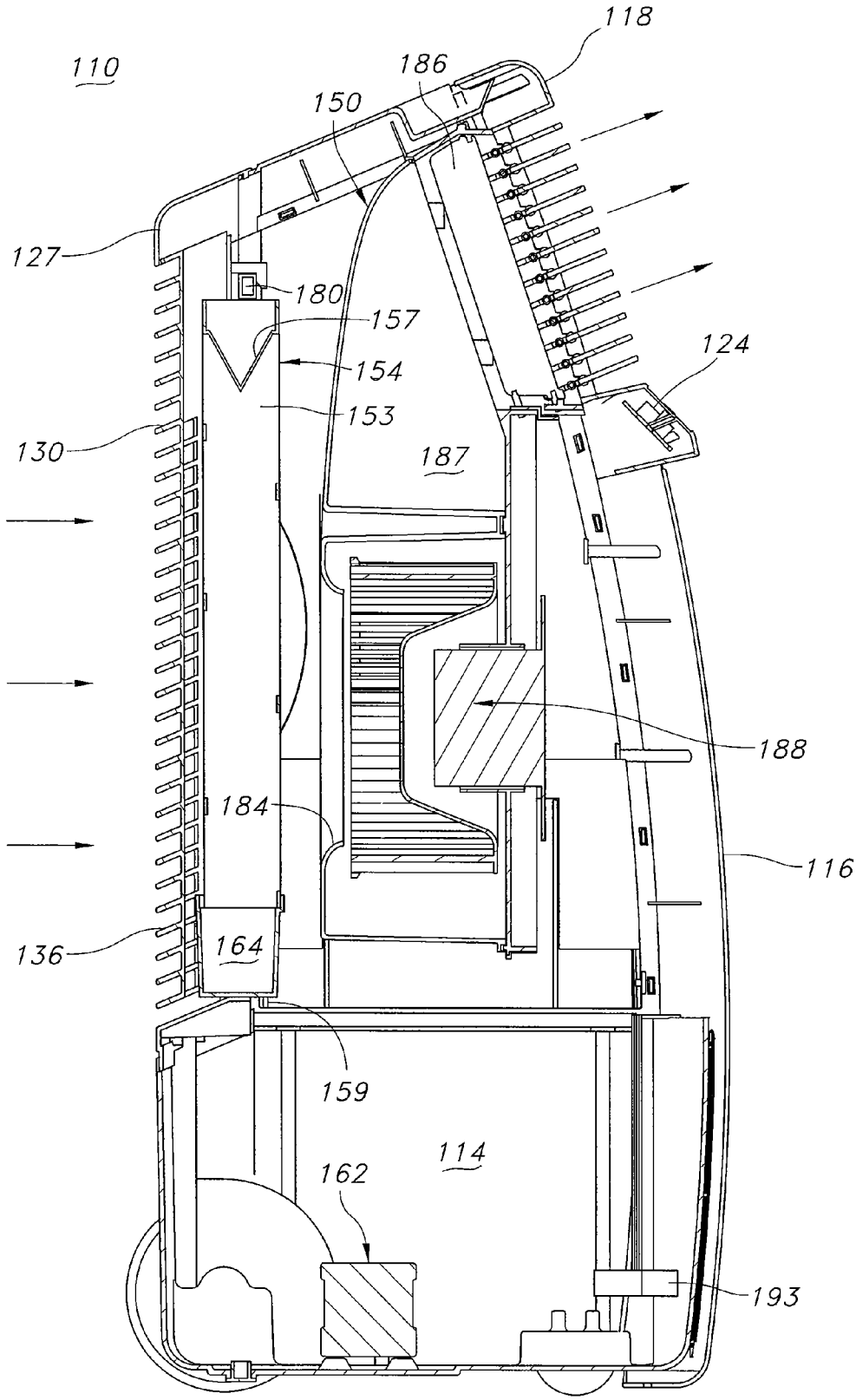
FIG. 11 depicts a cross-sectional side view of the evaporative cooler of FIG. 9 taken along the lines 11-11.
Figure 12:
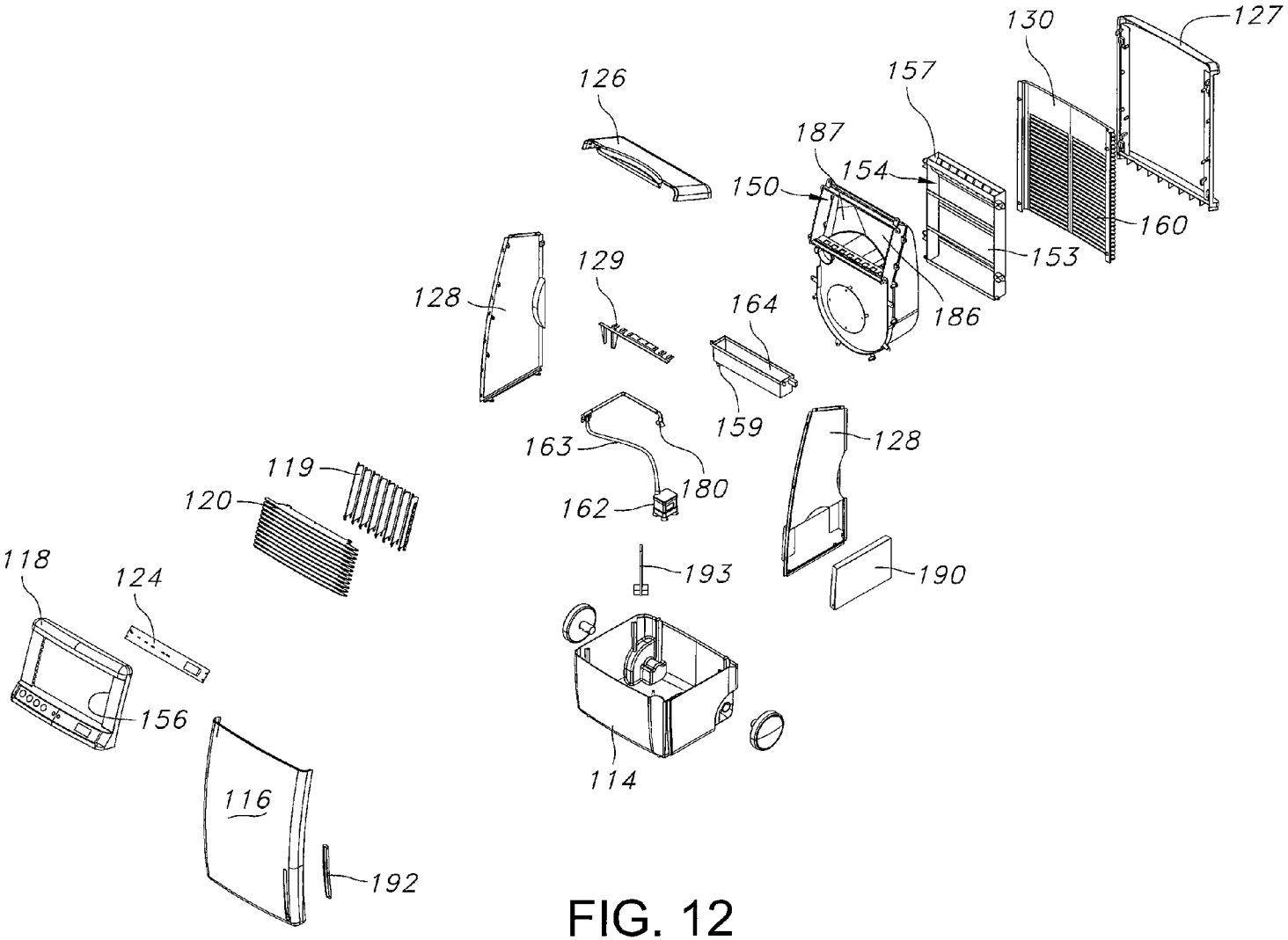
FIG. 12 depicts an exploded perspective view of the evaporative cooler of FIG. 8.

FIGS. 8-12 depict another exemplary embodiment of an evaporative cooler 110. The evaporative cooler 110 of FIGS. 8-12 is substantially similar to the evaporative cooler 10 of FIGS. 1-7 with some notable exceptions, as described hereinafter. FIGS. 8-10 depict perspective, front elevation and rear elevation views, respectively, of the evaporative cooler 110. FIG. 11 depicts a cross-sectional side view of the cooler 110 of FIG. 9 taken along the lines 11-11. FIG. 12 depicts an exploded perspective view of the cooler 110.

The evaporative cooler 110 generally includes a cooler housing 112 having front, top, rear and side panels together defining an interior region. A reservoir 114 configured to contain water is mounted beneath the cooler housing 112 to one or more of the panels of the cooler housing 112. The reservoir 114 may also be considered to form part of the cooler housing 112.

The cooler housing 112 generally includes a front panel 116 and a front exhaust panel 118 positioned along and defining the front surface of the cooler housing 112. The front panel 116 and the front exhaust panel 118 may be two separate components, as shown, or, alternatively, may be provided as a single, unitary front panel. Unlike the front intake panel 16 of the cooler 10 shown in FIG. 1, the front panel 116 of the cooler housing 112 does not includes an inlet opening. The front panel 116 includes a transparent portion 192 to provide a window for observing the water level within the reservoir 114, such that a user can determine when refilling of the reservoir 114 becomes necessary.

Although not shown, the transparent portion 192 (or the front panel 116) may include indicia for indicating the fill level of the reservoir 114. Alternatively, or in combination with the indicia, a water level float 193 may be positioned within the reservoir 114 and moveably coupled to the front panel 116, such that the float 193 is visible through the transparent portion 192. In use, a user may more easily gauge the water level within the reservoir 114 by observing the position of the water level float 193 with respect to the indicia.

The front exhaust panel 118 is positioned at an elevation above the front panel 116, and defines an outlet opening 156 (see FIG. 12) positioned for the forward exhaust of cooled air from the interior of the cooler housing 112, as depicted by the arrows in FIG. 11. An exhaust grille 122 is positioned over the front exhaust panel 118. Additionally, the grille 122 may be integrated with the front exhaust panel 118, or they may be separate components. The exhaust grille 122 optionally includes a series of fixed louvers 123 defined along its height dimension. The louvers 123 can also be manually adjustable upward or downward in unison to change the expelled direction of the air. The louvers 123 are oriented to exhaust the cooled air at an upward angle with respect to the floor surface. As an alternative to louvers and although not shown, the exhaust grille 122 may incorporate a perforated mesh material or a wire material having small apertures sized for the passage of air. The ornamental shape and appearance of the louvers or other grille components are selected to provide an aesthetic appearance to the cooler 110. It will be appreciated that a wide variety of louver or grille configurations are optionally selected without compromising the performance of the cooler 110.

A series of vertically oriented, tiltable louvers 119 are mounted to the interior side of the fixed louvers 123. A louver oscillation bracket 129 interfaces with one or more of the tiltable louvers 119 for adjustably tilting the louvers 119 in a side-to-side direction. Tilting the louvers 119 adjusts the flowpath of the exhaust air.

The cooler housing 112 includes a rear intake panel 130 positioned along the rear surface of the cooler housing 112. The rear intake panel 130 defines an inlet opening 160 positioned for the forward intake of ambient air into the interior of the cooler housing 112, as depicted by the arrows in FIG. 11. The rear intake panel 130 optionally includes a series of fixed louvers 136 defined along its height dimension. As best shown in FIG. 11, the louvers 136 are optionally angled with respect to a horizontal plane and are substantially parallel to the sloped top of the cooler 110 for ornamentation. As an alternative to louvers, and although not shown, the rear intake panel 130 may incorporate a mesh or wire material having small apertures sized for the passage of air.

Two side panels 128 of the cooler housing 112 are positioned along the side surfaces of the cooler housing 112. The side panels 128 are substantially closed to air flow to force the flow of air through the inlet opening 160. As best shown in FIG. 8, one side panel 128 includes a removable door 190 for providing manual access to the interior of the reservoir 114. In use, the door 190 is removed (or moved) for refilling the reservoir 114 with water. The removable door 190 may also be captively mounted to the side panel 128.

According to one aspect of the invention, the door 190 is hingedly coupled to the side panel 128 and pivots about its lower edge or another edge. The door 190 hinges open from the top if hinged to pivot about its lower edge and is accessed by a user at the scalloped portion 132 of the side panel 128 just above the door 190 to allow the user to pour water into the reservoir 114.

A top panel 126 is positioned along the top surface of the cooler housing 112. The top panel 126 may be transversely oriented with respect to a horizontal plane, as shown, for purposes of ornamentation. An intermediate panel 127 is positioned along the rear surface of the cooler housing 112 and coupled to both side panels 128, the rear panel 130, the top panel 126, and the reservoir 114. The rear intake panel 130 is fastened to the intermediate panel 127 by fasteners (not shown). The intermediate panel 127 may be integrated with the rear intake panel 130 or they may be two separate components, as shown.

An ornamentally designed control panel 124, similar in function to control panel 24 of FIG. 1, is configured for controlling the operation of the evaporative cooler 110 and is optionally positioned along the front surface of the cooler housing 112.

FIGS. 11 and 12 depict the internal components of the evaporative cooler 110. The internal components of the evaporative cooler 110 are similar to those of the cooler 10, with a few notable exceptions. The evaporative cooler 110 includes an air blower 150 for inducing the flow of ambient air through the inlet port 160, drawing air through a media pad 153 for heat exchange, and exhausting the cooled air through the outlet port 156 defined in the front exhaust panel 118. Because the cooler 110 differs from cooler 10 in that it does not include an internal frame structure, the blower 150 is mounted to the front panels 116 and 118.

The air blower 150 defines one inlet port 184 for receiving air, and one outlet port 186 for exhausting air. As best shown in FIG. 11, an air channel 187 is defined within the interior of the air blower 150 for providing a passageway for the flow of air between the inlet port 184 and the outlet port 186 of the blower 150. Similar to the air blower 50 of FIG. 6, the air blower 150 includes a motorized impeller 188, or other means, for drawing air through the air channel 187.

The outlet port 186 of the blower 150 is aligned with the outlet port 156 of the front exhaust panel 118. The inlet port 184 of the air blower 150 is positioned adjacent rear panel 130 and media pad 153. Unlike blower 50, blower 150 has an axis that is perpendicular to the front and rear surfaces of the cooler housing 112. Accordingly, the inlet 184 of the blower is oriented toward the rear intake panel 130.

The media pad housing 154, which includes the media pad 153 contained therewithin, is releasably mounted to the interior side of the rear intake panel 130 by fasteners or other fastening means. The media pad housing 154 is positioned proximate to the inlet opening 160 provided in the rear intake panel 130. The media pad 153 consumes nearly the entire width of the cooler housing 112. The media pad housing 154 includes a "V"-shaped inlet channel 157 for channeling water onto a top surface of the media pad 153.

Similar to the cooler 10 as illustrated in FIG. 5, the evaporative cooler 110 includes a water distribution system configured for continuously wetting the media pad 153. More particularly, the water distribution system generally includes a submersible water pump 162, a hollow conduit 163, and two nozzles 180 disposed at the end of the conduit 163. The water pump 162 is mounted to the floor of the reservoir 114. The water pump 162 is configured to deliver water from the reservoir 14 and into the conduit 163. The water is expelled onto the top surface of the media pad 153 through two nozzles 180 provided at the end of the conduit 163. The nozzles 180 are sufficiently spaced from the inlet port 184 of the air blower 150 to limit or prevent expelled water from being drawn directly into the inlet port 184.

An overflow reservoir 164 is mounted to the underside of the media housing 154 by a fastener or other fastening means. The overflow reservoir 164 is provided for collecting excess water expelled from the media pad 153. The overflow reservoir 164 includes an aperture 159 positioned for distributing the excess water back into the reservoir 114.

Like cooler 10, cooler 110 includes wheels or casters that facilitate movement of the cooler 110. Wheels positioned at the rear surface of the cooler housing 112 permit the tilting of the cooler 110 for movement across a surface.

Although this invention has been described with reference to exemplary embodiments and variations thereof, it will be appreciated that additional variations and modifications can be made within the spirit and scope of this invention. For example, the components of the cooler embodiments described herein can be formed from a wide variety of materials (e.g., metallic and non-metallic materials) and can be formed using a wide variety of forming techniques (e.g., stamping, molding, machining, etc.). Additionally, the ornamental appearance of the cooler embodiments illustrated herein can be changed or modified without compromising the performance and operation of the coolers.

What is claimed:

1. An evaporative cooler comprising:

a cooler housing having front, rear and side surfaces together defining an interior region, the front surface of the cooler housing defining an outlet opening positioned for the forward exhaust of cooled air from the interior of the cooler housing, the front surface of the cooler housing further defining an inlet opening spaced from the outlet opening and positioned for the rearward intake of ambient air into the interior of the cooler housing;

media positioned within the interior of the cooler housing and adjacent the inlet opening defined in the front surface of the cooler housing such that the intake of ambient air passes through the media for heat exchange; and a blower mounted within the interior of the cooler housing, the blower having an inlet and an outlet and being configured to move air from the inlet to the outlet, the inlet of the blower being oriented to receive ambient air entering the interior of the cooler housing through the inlet opening defined in the front surface of the cooler housing, and the outlet of the blower being oriented for the forward exhaust of cooled air from the outlet of the blower and toward the outlet opening defined in the front surface of the cooler housing;

wherein the cooler housing is configured to be moved along a surface and the outlet of the blower is oriented to exhaust the cooled air at an upward angle with respect to the surface.

2. The evaporative cooler of claim 1, further comprising an inlet opening defined on the rear surface of the cooler housing and positioned for the forward intake of ambient air into the interior of the cooler housing.

3. The evaporative cooler of claim 1, wherein the side surfaces of the cooler housing are substantially closed to air flow.

4. The evaporative cooler of claim 1, wherein the inlet opening defined in the front surface is positioned at an elevation below the outlet opening defined in the front surface.

5. The evaporative cooler of claim 1 further comprising wheels or casters coupled to the cooler housing to facilitate rolling of the evaporative cooler along the surface.

6. The evaporative cooler of claim 1 further comprising a control panel positioned on the front surface of the cooler housing for operating the blower.

* * * * *